US009165526B2

(12) United States Patent
Gu et al.

(10) Patent No.: US 9,165,526 B2
(45) Date of Patent: Oct. 20, 2015

(54) SUBPIXEL ARRANGEMENTS OF DISPLAYS AND METHOD FOR RENDERING THE SAME

(75) Inventors: Jing Gu, Shanghai (CN); Keigo Hirakawa, Dayton, OH (US)

(73) Assignee: SHENZHEN YUNYINGGU TECHNOLOGY CO., LTD., Shenzhen (CN)

( * ) Notice: Subject to any disclaimer, the term of this patent is extended or adjusted under 35 U.S.C. 154(b) by 252 days.

(21) Appl. No.: 13/406,611

(22) Filed: Feb. 28, 2012

(65) Prior Publication Data

US 2013/0222442 A1 Aug. 29, 2013

(51) Int. Cl.
*G09G 5/02* (2006.01)
*G09G 3/20* (2006.01)

(52) U.S. Cl.
CPC ..... *G09G 5/02* (2013.01); *G09G 3/2003* (2013.01); *G09G 2300/0426* (2013.01); *G09G 2300/0452* (2013.01); *G09G 2340/0457* (2013.01)

(58) Field of Classification Search
USPC ..... 345/694
See application file for complete search history.

(56) References Cited

U.S. PATENT DOCUMENTS

| | | | | |
|---|---|---|---|---|
| 5,113,274 | A * | 5/1992 | Takahashi et al. | 349/109 |
| 5,619,225 | A * | 4/1997 | Hashimoto | 345/98 |
| 6,793,309 | B2 * | 9/2004 | McCay et al. | 347/15 |
| 7,184,066 | B2 * | 2/2007 | Elliot et al. | 345/694 |
| 7,286,136 | B2 | 10/2007 | Phan | |
| 7,397,455 | B2 | 7/2008 | Brown Elliott et al. | |
| 7,499,116 | B2 * | 3/2009 | Tsai et al. | 349/38 |
| 7,583,279 | B2 | 9/2009 | Brown Elliott et al. | |
| 8,013,817 | B2 * | 9/2011 | Miller et al. | 345/83 |
| 8,717,255 | B2 * | 5/2014 | Phan | 345/55 |
| 2002/0191130 | A1 * | 12/2002 | Liang et al. | 349/108 |
| 2003/0034992 | A1 | 2/2003 | Brown Elliott et al. | |
| 2005/0270444 | A1 * | 12/2005 | Miller et al. | 349/108 |
| 2007/0085862 | A1 * | 4/2007 | Moriya et al. | 345/694 |
| 2007/0146242 | A1 * | 6/2007 | Miller et al. | 345/76 |
| 2007/0257945 | A1 * | 11/2007 | Miller et al. | 345/694 |
| 2010/0118045 | A1 | 5/2010 | Brown Elliott et al. | |
| 2010/0141693 | A1 | 6/2010 | Lee et al. | |
| 2010/0164978 | A1 | 7/2010 | Brown Elliott et al. | |
| 2011/0057950 | A1 * | 3/2011 | Kim et al. | 345/602 |
| 2011/0248294 | A1 | 10/2011 | Weaver et al. | |
| 2011/0285714 | A1 | 11/2011 | Swic et al. | |
| 2013/0265338 | A1 * | 10/2013 | Chaji et al. | 345/690 |

FOREIGN PATENT DOCUMENTS

TW 200905637 A 2/2009

OTHER PUBLICATIONS

International Search Report corresponding to PCT/US2013/021845, Date of Mailing of the International Search Report—Mar. 29, 2013.

* cited by examiner

*Primary Examiner* — Kwang-Su Yang
(74) *Attorney, Agent, or Firm* — Pillsbury Winthrop Shaw Pittman LLP

(57) ABSTRACT

An apparatus including a display and control logic is provided. In one example, the display includes an array of subpixels having a subpixel repeating group tiled across the display in a regular pattern. The subpixel repeating group comprises n rows of subpixels and n columns of subpixels. Each row of the subpixel repeating group comprises n types of subpixels. Each column of the subpixel repeating group comprises the n types of subpixels. Subpixels along each diagonal direction of the subpixel repeating group comprise at least two types of the n types of subpixels. The control logic is operatively coupled to the display and is configured to receive display data and render the display data into control signals for driving the array of subpixels of the display.

17 Claims, 10 Drawing Sheets

402

| | | | |
|---|---|---|---|
| A | B | C | D |
| D | A | B | C |
| B | C | D | A |
| C | D | A | B |

FIG. 4A

400

406 404 408 402

| | | | | | | | | | | | | | | | |
|---|---|---|---|---|---|---|---|---|---|---|---|---|---|---|---|
| A | B | C | D | A | B | C | D | A | B | C | D | A | B | C | D |
| D | A | B | C | D | A | B | C | D | A | B | C | D | A | B | C |
| B | C | D | A | B | C | D | A | B | C | D | A | B | C | D | A |
| C | D | A | B | C | D | A | B | C | D | A | B | C | D | A | B |
| A | B | C | D | A | B | C | D | A | B | C | D | A | B | C | D |
| D | A | B | C | D | A | B | C | D | A | B | C | D | A | B | C |
| B | C | D | A | B | C | D | A | B | C | D | A | B | C | D | A |
| C | D | A | B | C | D | A | B | C | D | A | B | C | D | A | B |
| A | B | C | D | A | B | C | D | A | B | C | D | A | B | C | D |
| D | A | B | C | D | A | B | C | D | A | B | C | D | A | B | C |
| B | C | D | A | B | C | D | A | B | C | D | A | B | C | D | A |
| C | D | A | B | C | D | A | B | C | D | A | B | C | D | A | B |
| A | B | C | D | A | B | C | D | A | B | C | D | A | B | C | D |
| D | A | B | C | D | A | B | C | D | A | B | C | D | A | B | C |
| B | C | D | A | B | C | D | A | B | C | D | A | B | C | D | A |
| C | D | A | B | C | D | A | B | C | D | A | B | C | D | A | B |

FIG. 4B

| | | | |
|---|---|---|---|
| A | B | C | D |
| B | D | A | C |
| C | A | D | B |
| D | C | B | A |

FIG. 6A

| | | | |
|---|---|---|---|
| A | B | C | D |
| C | D | A | B |
| B | A | D | C |
| D | C | B | A |

FIG. 6B

| | | | |
|---|---|---|---|
| A | B | C | D |
| C | D | A | B |
| B | C | D | A |
| D | A | B | C |

FIG. 6C

| | | | |
|---|---|---|---|
| A | B | C | D |
| D | C | A | B |
| B | A | D | C |
| C | D | B | A |

FIG. 6D

| | | | |
|---|---|---|---|
| A | B | C | D |
| C | D | A | B |
| D | A | B | C |
| B | C | B | A |

FIG. 6E

| | | | |
|---|---|---|---|
| A | B | C | D |
| D | A | B | C |
| B | C | D | A |
| C | D | A | B |

FIG. 6F

| | | | |
|---|---|---|---|
| A | B | C | D |
| B | C | D | A |
| D | A | B | C |
| C | D | A | B |

FIG. 6G

| | | | |
|---|---|---|---|
| A | B | C | D |
| D | C | B | A |
| B | A | D | C |
| C | D | A | B |

FIG. 6H

| | | | |
|---|---|---|---|
| A | B | C | D |
| B | A | D | C |
| D | C | B | A |
| C | D | A | B |

FIG. 6I

| | | | |
|---|---|---|---|
| A | B | C | D |
| B | D | A | C |
| D | C | B | A |
| C | A | D | B |

FIG. 6J

| | | | |
|---|---|---|---|
| A | B | C | D |
| D | C | B | A |
| B | D | A | C |
| C | A | D | B |

FIG. 6k

| | | | |
|---|---|---|---|
| A | B | C | D |
| C | A | D | B |
| D | C | B | A |
| B | D | A | C |

FIG. 6L

| | | | |
|---|---|---|---|
| A | B | C | D |
| D | C | B | A |
| C | A | D | B |
| D | B | A | C |

FIG. 6M

| | | | |
|---|---|---|---|
| A | B | C | D |
| C | D | A | B |
| D | C | B | A |
| B | A | D | C |

FIG. 6N

| | | | |
|---|---|---|---|
| A | B | C | D |
| D | C | B | A |
| C | D | A | B |
| B | A | D | C |

FIG. 6O

| | | | |
|---|---|---|---|
| A | B | C | D |
| C | D | B | A |
| D | C | A | B |
| B | A | D | C |

FIG. 6P

| | | | |
|---|---|---|---|
| A | B | C | D |
| D | C | A | B |
| C | D | B | A |
| B | A | D | c |

FIG. 6Q

SUBPIXEL ARRANGEMENTS OF DISPLAYS AND METHOD FOR RENDERING THE SAME

BACKGROUND

The disclosure relates generally to displays, and more particularly, to subpixel arrangements of displays and a method for rendering the same.

Displays are commonly characterized by display resolution, which is the number of distinct pixels in each dimension that can be displayed (e.g., 1920×1080). Many displays are, for various reasons, not capable of displaying different color channels at the same site. Therefore, the pixel grid is divided into single-color parts that contribute to the displayed color when viewed at a distance. In some displays, such as liquid crystal display (LCD), organic light emitting diode (OLED) display, electrophoretic ink (E-ink) display, or electroluminescent display (ELD), these single-color parts are separately addressable elements, which are known as subpixels.

Various subpixel arrangements (layouts, schemes) have been proposed to operate with a proprietary set of subpixel rendering algorithms in order to improve the display quality by increasing the apparent resolution of a display and by anti-aliasing text with greater details. For example, LCDs typically divide each pixel into three strip subpixels (e.g., red, green, and blue subpixels) or four quadrate subpixels (e.g., red, green, blue, and white subpixels) so that each pixel can present brightness and a full color. However, since human vision system is not as sensitive to brightness as to color, the known solutions of using three or four subpixels to constitute a full-color pixel are not always necessary.

Other known solutions take a different approach by dividing each pixel into two subpixels and arranging the subpixels tiled across the display in a specifically designed pattern. In order to keep the same apparent color resolution in a larger scale, it is desired to design the subpixel arrangement so that the pixels in a line along any direction of the display can still present full colors. In other words, different types (colors) of subpixels are desired to be uniformly distributed in each direction on the display. In addition, some of these known solutions divide each pixel into subpixels with different shapes and sizes, thereby causing extra hardship for manufacturing.

Accordingly, there exists a need for improved subpixel arrangements of displays and a method for rendering the same.

BRIEF DESCRIPTION OF THE DRAWINGS

The embodiments will be more readily understood in view of the following description when accompanied by the below figures and wherein like reference numerals represent like elements, wherein:

FIG. 4A is a depiction of a subpixel repeating group in accordance with one embodiment set forth in the disclosure;

FIG. 4B is a depiction of a subpixel arrangement of a display defined by the subpixel repeating group shown in FIG. 4A;

FIGS. 6A-6Q are depictions of subpixel repeating groups in accordance with various embodiments set forth in the disclosure;

SUMMARY

Figure 1:
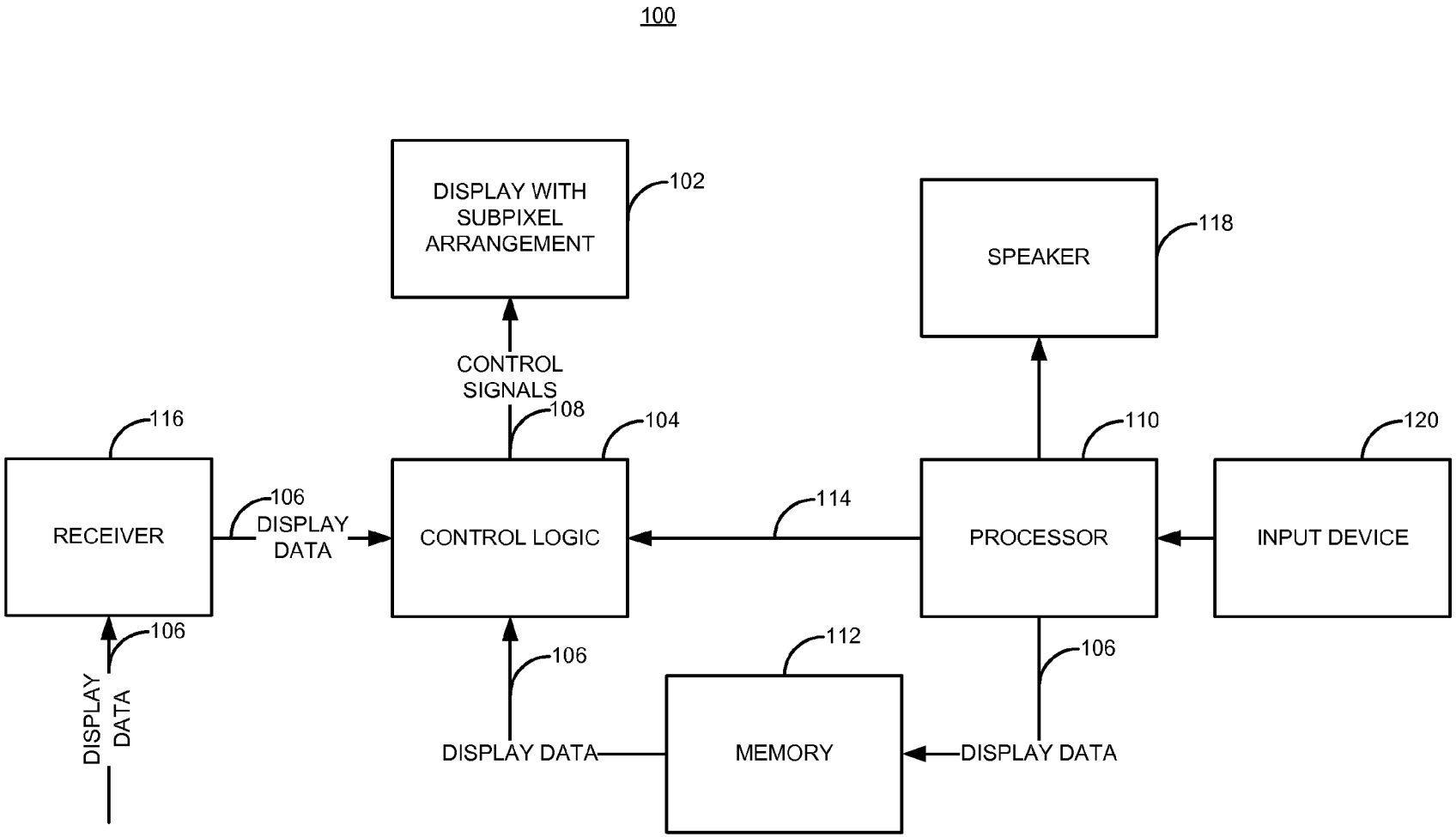
FIG. 1 is a block diagram illustrating an apparatus including a display and control logic.

The present disclosure describes subpixel arrangements of displays and a method for rendering the same. An apparatus including a display and control logic is provided. In one example, the display includes an array of subpixels having a subpixel repeating group tiled across the display in a regular pattern. The subpixel repeating group comprises n rows of subpixels and n columns of subpixels. Each row of the subpixel repeating group comprises n types of subpixels. Each column of the subpixel repeating group comprises the n types of subpixels. Subpixels along each diagonal direction of the subpixel repeating group comprise at least two types of the n types of subpixels. The control logic is operatively coupled to the display and is configured to receive display data and render the display data into control signals for driving the array of subpixels of the display.

A method for rendering subpixels of a display is also provided. The method may be implemented by the control logic of the apparatus or on any suitable machine having at least one processor. In one example, an arrangement of the array of subpixels provided above is first identified. Display data including, for each pixel for display, three parts of original subpixel data for rendering three types of subpixels of the display is then received. For each pixel for display, the display data is converted into converted display data based on the arrangement of the array of subpixels. Eventually, based on the converted display data, control signals are provided for rendering the array of subpixels of the display.

Among other advantages, the present disclosure provides the ability to reduce the number of subpixels while maintaining the same apparent display resolution, thereby reducing the cost and power consumption of the display, or to reduce the size of each pixel while keeping the same manufacturing process, thereby increasing the display resolution. The novel subpixel arrangements of the present disclosure make the color distribution of the display more uniform compared with known solutions, thereby increasing the user experience. In addition, because each pixel in the present disclosure may be divided equally into two subpixels instead of the conventional three strip subpixels or four quadrate subpixels, the number of addressable display elements per unit area of a display can be increased without changing the current manufacturing process.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

DETAILED DESCRIPTION

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

FIG. 1 illustrates an apparatus 100 including a display 102 and control logic 104. The apparatus 100 may be any suitable device, for example, a television set, laptop computer, desktop computer, netbook computer, media center, handheld device (e.g., dumb or smart phone, tablet, etc.), electronic billboard, gaming console, set-top box, printer, or any other suitable device. In this example, the display 102 is operatively coupled to the control logic 104 and is part of the apparatus 100, such as but not limited to, a television screen, computer monitor, dashboard, head-mounted display, or electronic billboard. The display 102 may be a LCD, OLED display, E-ink display, ELD, billboard display with incandescent lamps, or any other suitable type of display. The control logic 104 may be any suitable hardware, software, firmware, or combination thereof, configured to receive display data 106 and render the received display data 106 into control signals 108 for driving the array of subpixels of the display 102. For example, subpixel rendering algorithms for various subpixel arrangements may be part of the control logic 104 or implemented by the control logic 104. The control logic 104 may include any other suitable components, including an encoder, a decoder, one or more processors, controllers (e.g., timing controller), and storage devices. One example of the control logic 104 and a method for rendering subpixels of the display 102 implemented by the control logic 104 are described in detail with reference to FIGS. 9 and 10, respectively. The apparatus 100 may also include any other suitable component such as, but not limited to, a speaker 118 and an input device 120, e.g., a mouse, keyboard, remote controller, handwriting device, camera, microphone, scanner, etc.

In one example, the apparatus 100 may be a laptop or desktop computer having a display 102. In this example, the apparatus 100 also includes a processor 110 and memory 112. The processor 110 may be, for example, a graphic processor (e.g., GPU), a general processor (e.g., APU, accelerated processing unit; GPGPU, general-purpose computing on GPU), or any other suitable processor. The memory 112 may be, for example, a discrete frame buffer or a unified memory. The processor 110 is configured to generate display data 106 in display frames and temporally store the display data 106 in the memory 112 before sending it to the control logic 104. The processor 110 may also generate other data, such as but not limited to, control instructions 114 or test signals, and provide them to the control logic 104 directly or through the memory 112. The control logic 104 then receives the display data 106 from the memory 112 or from the processor 110 directly.

In another example, the apparatus 100 may be a television set having a display 102. In this example, the apparatus 100 also includes a receiver 116, such as but not limited to, an antenna, radio frequency receiver, digital signal tuner, digital display connectors, e.g., HDMI, DVI, DisplayPort, USB, Bluetooth, WiFi receiver, or Ethernet port. The receiver 116 is configured to receive the display data 106 as an input of the apparatus 100 and provide the native or modulated display data 106 to the control logic 104.

In still another example, the apparatus 100 may be a handheld device, such as a smart phone or a tablet. In this example, the apparatus 100 includes the processor 110, memory 112, and the receiver 116. The apparatus 100 may both generate display data 106 by its processor 110 and receive display data 106 through its receiver 116. For example, the apparatus 100 may be a handheld device that works as both a portable television and a portable computing device. In any event, the apparatus 100 at least includes the display 102 with specifically designed subpixel arrangements as described below in detail and the control logic 104 for the specifically designed subpixel arrangements of the display 102.

Figure 2:
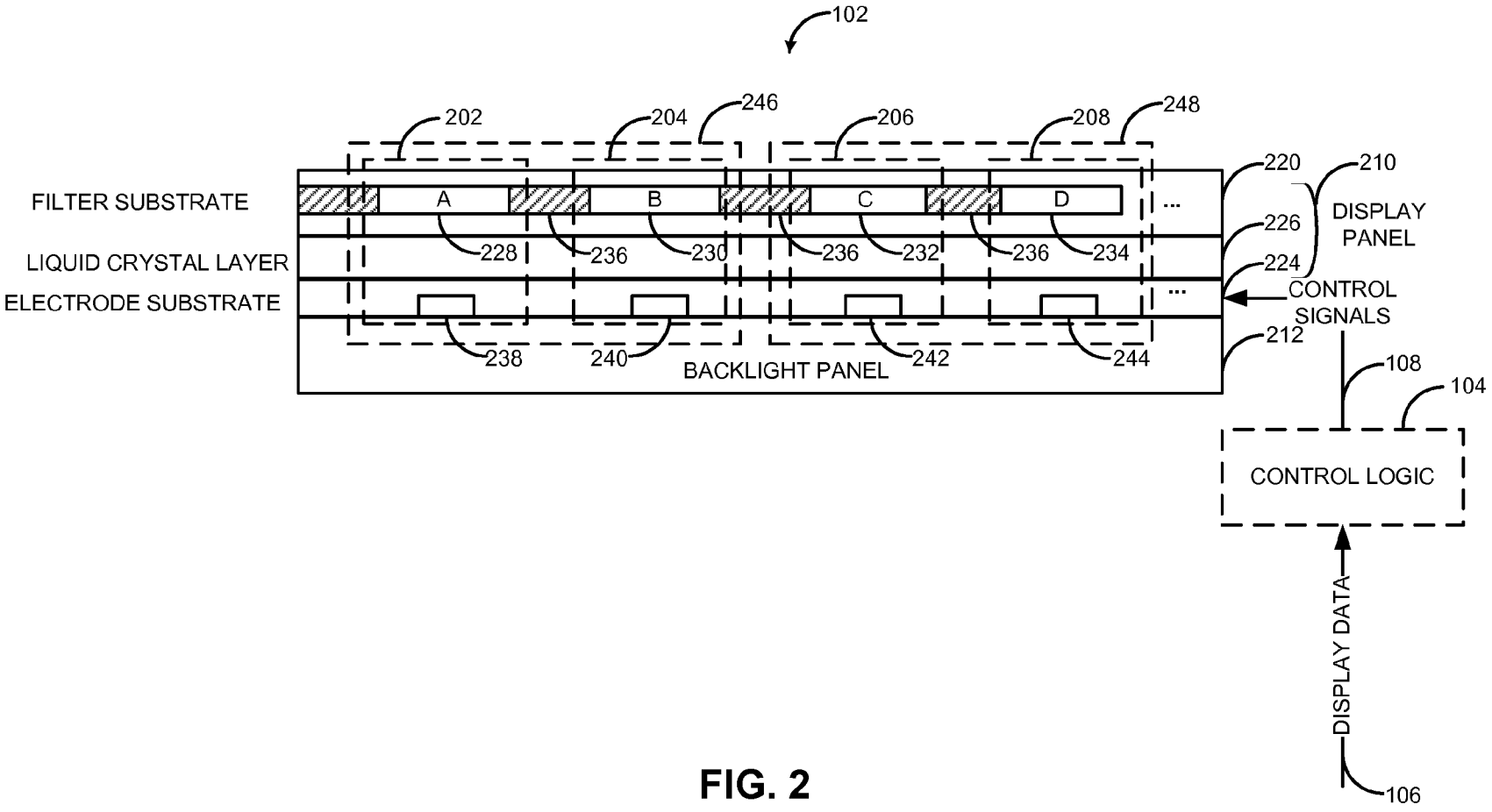
FIG. 2 is a diagram illustrating one example of the display of the apparatus shown in FIG. 1 in accordance with one embodiment set forth in the disclosure.

FIG. 2 illustrates one example of the display 102 including an array of subpixels 202, 204, 206, 208. The display 102 may be any suitable type of display, for example, LCDs, such as a twisted nematic (TN) LCD, in-plane switching (IPS) LCD, advanced fringe field switching (AFFS) LCD, vertical alignment (VA) LCD, advanced super view (ASV) LCD, blue phase mode LCD, passive-matrix (PM) LCD, or any other suitable display. The display 102 may include a display panel 210 and a backlight panel 212, which are operatively coupled to the control logic 104. The backlight panel 212 includes light sources for providing lights to the display panel 210, such as but not limited to, incandescent light bulbs, LEDs, EL panel, cold cathode fluorescent lamps (CCFLs), and hot cathode fluorescent lamps (HCFLs), to name a few.

The display panel 210 may be, for example, a TN panel, an IPS panel, an AFFS panel, a VA panel, an ASV panel, or any other suitable display panel. In this example, the display panel 210 includes a filter substrate 220, an electrode substrate 224, and a liquid crystal layer 226 disposed between the filter substrate 220 and the electrode substrate 224. As shown in FIG. 2, the filter substrate 220 includes a plurality of filters 228, 230, 232, 234 corresponding to the plurality of subpixels 202, 204, 206, 208, respectively. A, B, C, and D in FIG. 2 denote four different types of filters, such as but not limited to, red, green, blue, yellow, cyan, magenta, or white filter. The filter substrate 220 may also include a black matrix 236 disposed between the filters 228, 230, 232, 234 as shown in FIG. 2. The black matrix 236, as the borders of the subpixels 202, 204, 206, 208, is used for blocking the lights coming out from the parts outside the filters 228, 230, 232, 234. In this example, the electrode substrate 224 includes a plurality of electrodes 238, 240, 242, 244 with switching elements, such as thin film transistors (TFTs), corresponding to the plurality of filters 228, 230, 232, 234 of the plurality of subpixels 202, 204, 206, 208, respectively. The electrodes 238, 240, 242, 244 with the switching elements may be individually addressed by the control signals 108 from the control logic 104 and are configured to drive the corresponding subpixels 202, 204, 206, 208 by controlling the light passing through the respective filters 228, 230, 232, 234 according to the control signals 108. The display panel 210 may include any other suitable component, such as one or more glass substrates, polarization layers, or a touch panel, as known in the art.

As shown in FIG. 2, each of the plurality of subpixels 202, 204, 206, 208 is constituted by at least a filter, a corresponding electrode, and the liquid crystal region between the corresponding filter and electrode. The filters 228, 230, 232, 234 may be formed of a resin film in which dyes or pigments having the desired color are contained. Depending on the characteristics (e.g., color, thickness, etc.) of the respective filter, a subpixel may present a distinct color and brightness. In this example, two adjacent subpixels may constitute one pixel for display. For example, the subpixels A 202 and B 204 may constitute a pixel 246, and the subpixels C 206 and D 208 may constitute another pixel 248. Here, since the display data 106 is usually programmed at the pixel level, the two subpixels of each pixel or the multiple subpixels of several adjacent pixels may be addressed collectively by subpixel rendering to present the brightness and color of each pixel, as designated in the display data 106, with the help of subpixel rendering. However, it is understood that, in other examples, the display data 106 may be programmed at the subpixel level such that the display data 106 can directly address individual subpixel without the need of subpixel rendering. Because it usually requires three primary colors (red, green, and blue) to present a full color, specifically designed subpixel arrangements are provided below in detail for the display 102 to achieve an appropriate apparent color resolution.

Figure 3:
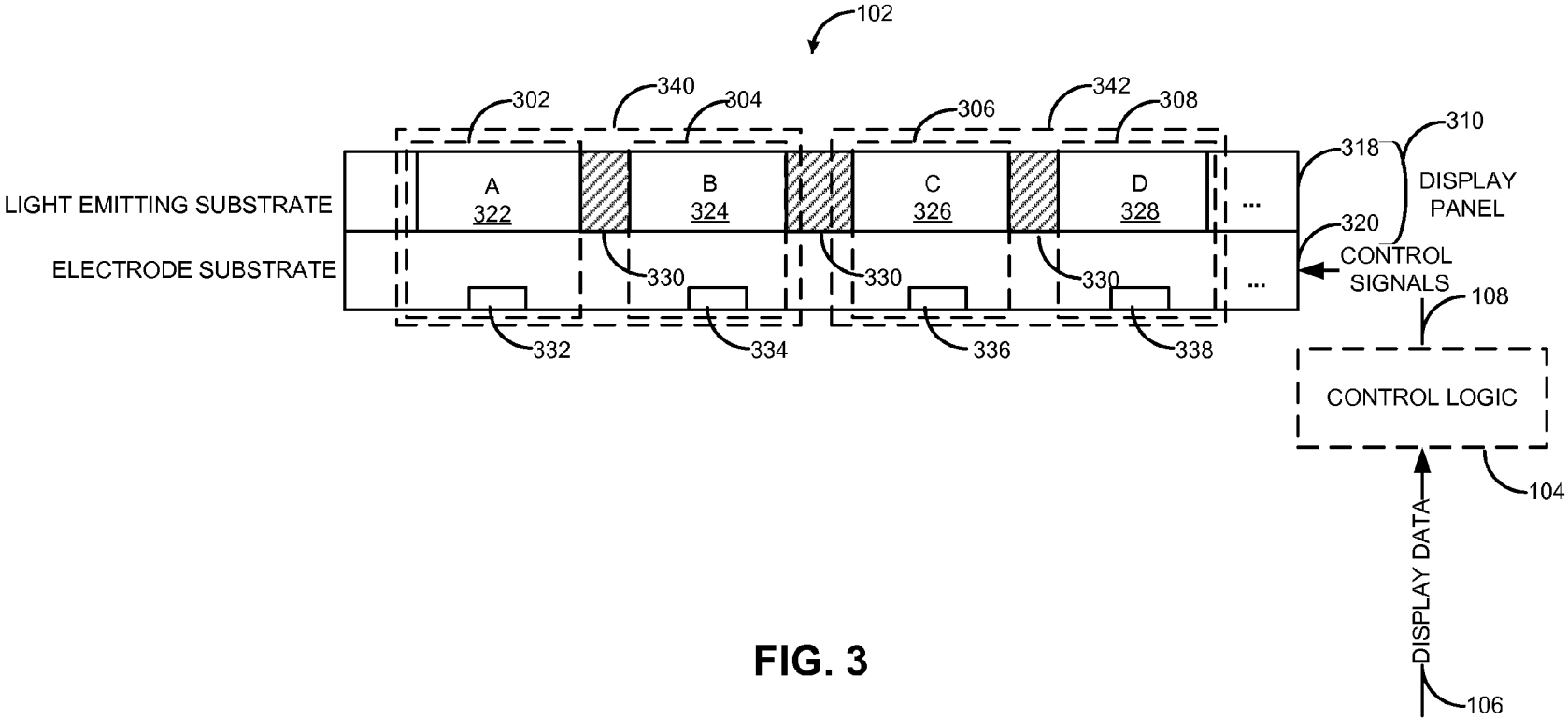
FIG. 3 is a diagram illustrating another example of the display of the apparatus shown in FIG. 1 in accordance with one embodiment set forth in the disclosure.

FIG. 3 illustrates another example of a display 102 including an array of subpixels 302, 304, 306, 308. The display 102 may be any suitable type of display, for example, OLED displays, such as an active-matrix (AM) OLED display, passive-matrix (PM) OLED display, or any other suitable display. The display 102 may include a display panel 310 operatively coupled to the control logic 104. Different from FIG. 2, a backlight panel may not be necessary for an OLED display 102 in FIG. 3 as the display panel 310 can emit lights by the OLEDs therein.

In this example, the display panel 310 includes a light emitting substrate 318 and an electrode substrate 320. As shown in FIG. 3, the light emitting substrate 318 includes a plurality of OLEDs 322, 324, 326, 328 corresponding to the plurality of subpixels 302, 304, 306, 308, respectively. A, B, C, and D in FIG. 3 denote four different types of OLEDs, such as but not limited to, red, green, blue, yellow, cyan, magenta, or white OLED. The light emitting substrate 318 may also include a black matrix 330 disposed between the OLEDs 322, 324, 326, 328, as shown in FIG. 3. The black matrix 330, as the borders of the subpixels 302, 304, 306, 308, is used for blocking the lights coming out from the parts outside the OLEDs 322, 324, 326, 328. Different from FIG. 2, a filter substrate may not be necessary for an OLED display 102 as each OLED in the light emitting substrate 318 can emit the light with a predetermined color and brightness. In this example, the electrode substrate 320 includes a plurality of electrodes 332, 334, 336, 338 with switching elements, such as TFTs, corresponding to the plurality of OLEDs 322, 324, 326, 328 of the plurality of subpixels 302, 304, 306, 308, respectively. The electrodes 332, 334, 336, 338 with the switching elements may be individually addressed by the control signals 108 from the control logic 104 and are configured to drive the corresponding subpixels 302, 304, 306, 308 by controlling the light emitting from the respective OLEDs 322, 324, 326, 328 according to the control signals 108. The display panel 310 may include any other suitable component, such as one or more glass substrates, polarization layers, or a touch panel, as known in the art.

As shown in FIG. 3, each of the plurality of subpixels 302, 304, 306, 308 is constituted by at least an OLED and a corresponding electrode. Each OLED may be formed by a sandwich structure of anode, light emitting layers, and cathode, as known in the art. Depending on the characteristics (e.g., material, structure, etc.) of the light emitting layers of the respective OLED, a subpixel may present a distinct color and brightness. In this example, two adjacent subpixels may constitute one pixel for display. For example, the subpixels A 302 and B 304 may constitute a pixel 340, and the subpixels C 306 and D 308 may constitute another pixel 342. Here, since the display data 106 is usually programmed at the pixel level, the two subpixels of each pixel or the multiple subpixels of several adjacent pixels may be addressed collectively by subpixel rendering to present the appropriate brightness and color of each pixel, as designated in the display data 106, with the help of subpixel rendering. However, it is understood that, in other examples, the display data 106 may be programmed at the subpixel level such that the display data 106 can directly address individual subpixel without the need of subpixel rendering. Because it usually requires three primary colors (red, green, and blue) to present a full color, specifically designed subpixel arrangements are provided below in detail for the display 102 to achieve an appropriate apparent color resolution.

Although FIGS. 2 and 3 are illustrated as a LCD display and an OLED display, respectively, it is understood that FIGS. 2 and 3 are provided for an exemplary purpose only and without limitations. As noted above, in addition to LCD and OLED display, the display 102 may be an E-ink display, an ELD, a billboard display with incandescent lamps, or any other suitable type of display.

FIGS. 4A and 4B depict a subpixel arrangement of a display 400 defined by a subpixel repeating group 402. The display 400 includes an array of subpixels having a subpixel repeating group 402 tiled across the display 400 in a regular pattern. A, B, C, and D in FIGS. 4A and 4B denote four different types of subpixels, such as but not limited to, red, green, blue, yellow, cyan, magenta, or white subpixel. FIG. 4B may be, for example, a top view of the display 102 and depicts one example of the subpixel arrangements of the display 400. Referring to FIG. 4A, the subpixel repeating group 402 in this example is a four by four matrix, including four rows and four columns of subpixels. Each row of the subpixel repeating group 402 in this example includes four types of subpixels, i.e., A, B, C, and D. In other words, subpixels in each row of the subpixel repeating group 402 are different from each other. Also, each column of the subpixel repeating group 402 in this example includes the four types of subpixels, i.e., A, B, C, and D. That is, subpixels in each column of the subpixel repeating group 402 are also different from each other. Accordingly, any two adjacent subpixels along the horizontal or vertical direction are different from each other. In addition, subpixels along each diagonal direction of the subpixel repeating group 402 include at least two types of the four types of subpixels (A, B, C, and D). In other words, subpixels along any diagonal direction in the subpixel repeating group 420 cannot be all the same. In this example, the subpixels along the first diagonal direction (e.g., A-A-D-B, from the top left corner to the bottom right corner) of the subpixel repeating group 402 includes three types of subpixels, i.e., A, B, and D, and the subpixels along the second diagonal direction (e.g., D-B-C-C, from the top right corner to the bottom left corner) of the subpixel repeating group 402 includes three types of subpixels, i.e., B, C, and D.

Referring to FIG. 4B, the subpixel arrangement of the display 400 may be defined by the subpixel repeating group 402 illustrated in FIG. 4A. In both the horizontal and vertical directions of the display 400, the subpixel arrangement may be described as the subpixel repeating group 402 repeating itself. In other words, the subpixel repeating group 402 is tiled across the display 400 in a regular pattern.

In this example, all the subpixels of the display 400 have the same shape and size, and two adjacent subpixels constitute one pixel for display. For example, each subpixel may have a substantially rectangular shape with an aspect ratio of about 2:1, as shown in FIG. 4B. In other words, each square pixel 404 is divided horizontally and equally into two rectangular subpixels 406, 408. As can be seen, each pixel of the display 400 may include subpixels with different colors because of the specifically designed subpixel arrangement. For example, the pixel 404 includes a subpixel A and a subpixel B, and another pixel on the right includes a subpixel C and a subpixel D.

Figure 5:
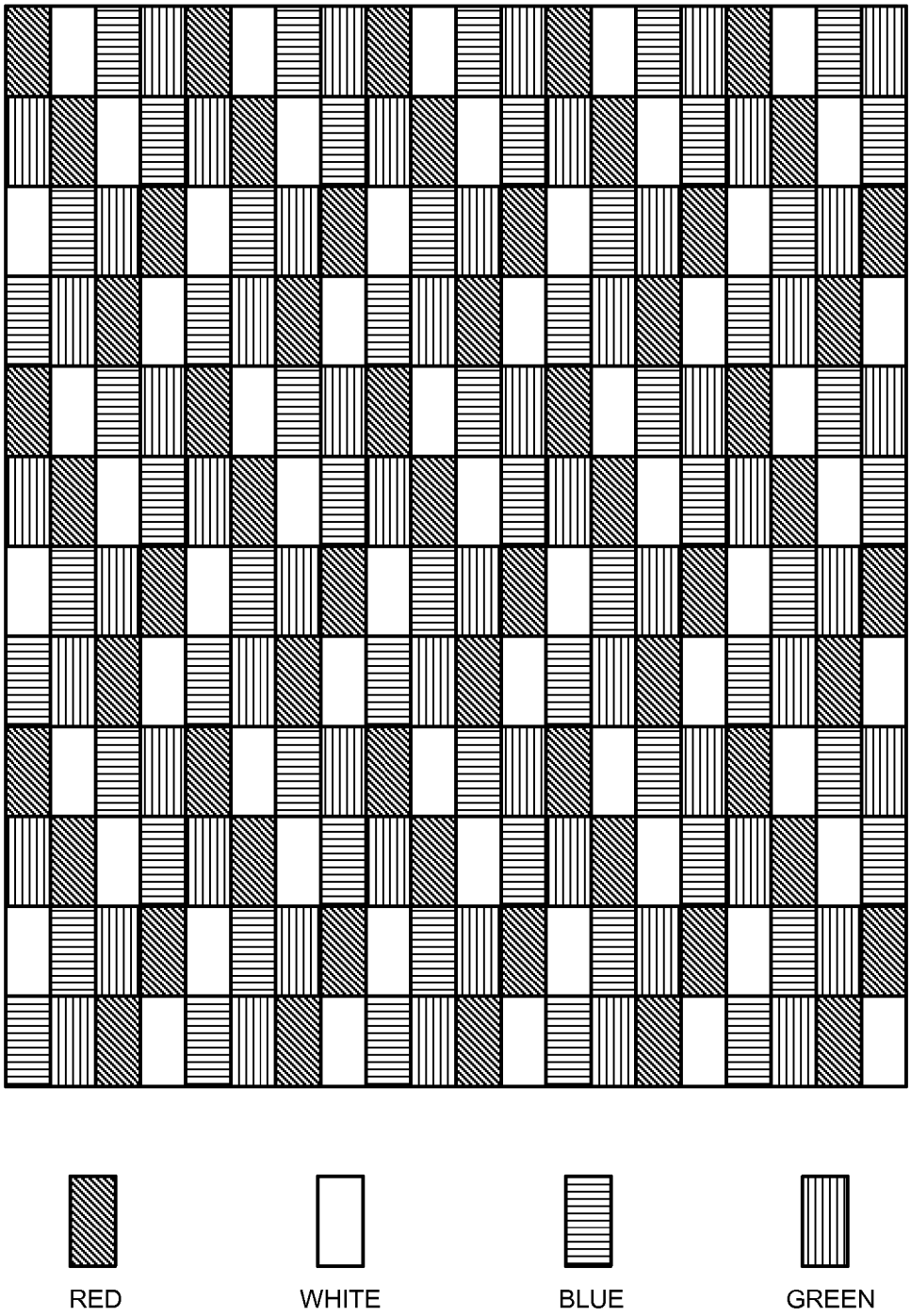
FIG. 5 is a depiction of a red, green, blue, and white subpixels arrangement of a display defined by the subpixel repeating group shown in FIG. 4A.

FIG. 5 depicts one example of the subpixel arrangement of the display 400 in FIG. 4B defined by the subpixel repeating group in FIG. 4A. In this example, the subpixel A is a red subpixel, the subpixel B is a white subpixel, the subpixel C is a blue subpixel, and the subpixel D is a green subpixel. In the case that the display 400 is a LCD, each type of subpixel may include a different filter. In the case that the display 400 is an OLED display, each type of subpixel may include an OLED emitting different color of light. In both the horizontal and vertical directions, the numbers of the red, green, blue, and white subpixels are evenly distributed, with each type of subpixel having ¼ of the total number of all subpixels in the respective direction. In addition, as shown in FIG. 5, the specifically designed subpixel arrangement ensures that the pixels along any diagonal direction of the display 400 are not all the same. Thus, the uniformity of color distribution of this subpixel arrangement is improved compared with known solutions as noted above. In this example, white subpixels are used to effectively increase the brightness of the display 102 without increasing the power consumption.

FIGS. 6A-6Q depict various examples of subpixel repeating group. The examples include, but are not limited to, the following patterns:

| | | | | | |
|---|---|---|---|---|---|
| A B C D | A B C D | A B C D | A B C D | A B C D | |
| B D A C | C D A B | C D A B | D C A B | C D A B | |
| C A D B | B A D C | B C D A | B A D C | D A B C | |
| D C B A, | D C B A, | D A B C, | C D B A, | B C D A, | |
| A B C D | A B C D | A B C D | A B C D | A B C D | A B C D |
| D A B C | B C D A | D C B A | B A D C | B D A C | D C B A |
| B C D A | D A B C | B A D C | D C B A | D C B A | B D A C |
| C D A B, | C D A B, | C D A B, | C D A B, | C A D B, | C A D B, |
| A B C D | A B C D | A B C D | A B C D | A B C D | A B C D |
| C A D B | D C B A | C D A B | D C B A | C D B A | D C A B |
| D C B A | C A D B | D C B A | C D A B | D C A B | C D B A |
| B D A C, | D B A C, | B A D C, | B A D C, | B A D C, and | B A D C, |

where A, B, C, and D denote our different types of subpixels, such as but not limited to, red, green, blue, yellow, cyan, magenta, or white subpixel.

All the examples in FIGS. 6A-6Q satisfy the requirements as noted above with respect to FIG. 4A. That is, (1) each subpixel repeating group includes four rows of subpixels and four columns of subpixels; (2) each row of the subpixel repeating group includes four types of subpixels; (3) each column of the subpixel repeating group includes the four types of subpixels; and (4) subpixels along each diagonal direction of the subpixel repeating group includes at least two types of the four types of subpixels.

Although all the exemplary subpixel repeating groups in FIGS. 6A-6Q are four by four matrices, it is understood that, the subpixel repeating group may be a larger matrix, e.g., a five by five matrix, a six by six matrix, etc. Accordingly, general rules may be applied to define the subpixel repeating groups. For example, (1) each subpixel repeating group includes n rows of subpixels and n columns of subpixels; (2) each row of the subpixel repeating group includes n types of subpixels; (3) each n of the subpixel repeating group includes the n types of subpixels; and (4) subpixels along each diagonal direction of the subpixel repeating group includes at least two types of the n types of subpixels. n may be any integer larger than three. In other words, any two adjacent subpixels along the horizontal or vertical direction of the subpixel repeating group are different from each other, and subpixels along any diagonal direction of the subpixel repeating group are not all the same.

Figure 7:
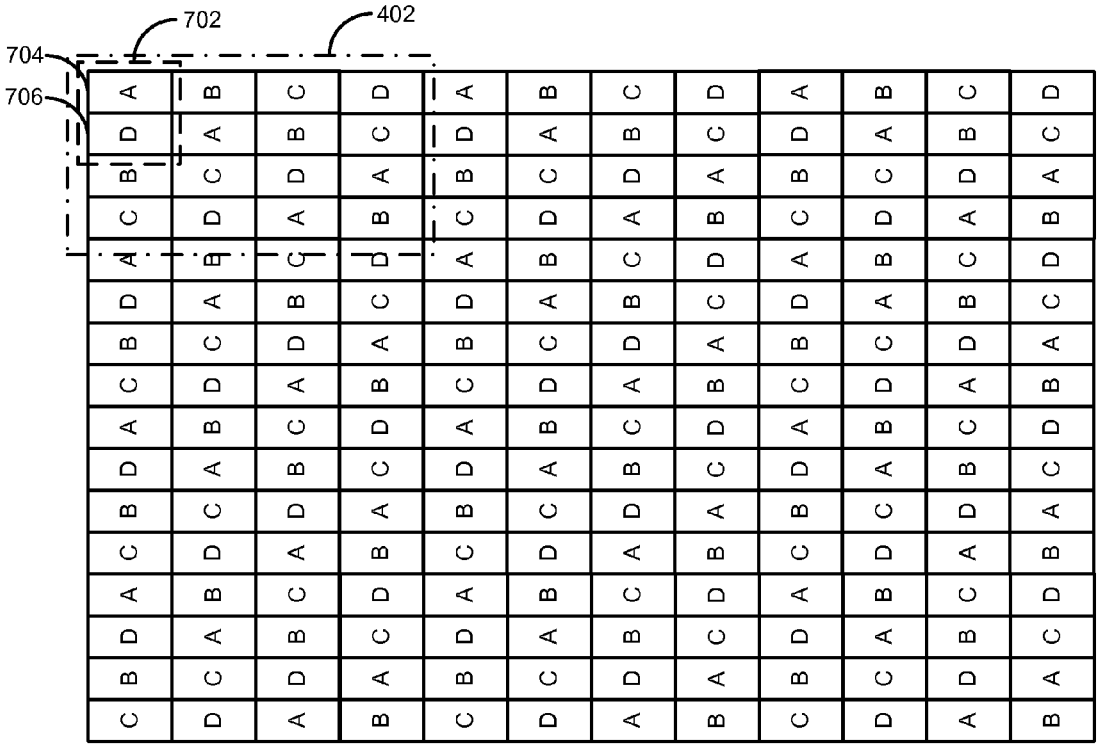
FIG. 7 is a depiction of another subpixel arrangement of a display defined by the subpixel repeating group shown in FIG. 4A.

All the subpixels in FIGS. 4-6 have substantially rectangular shapes with an aspect ratio of about 2:1. That is, each square pixel is divided horizontally and equally into two rectangular subpixels. However, it is understood that each square pixel may be divided differently in other examples. For example, FIG. 7 depicts another subpixel arrangement of a display 700 defined by the subpixel repeating group 402 in FIG. 4A. Different from FIG. 4B, each subpixel in this example has a substantially rectangular shape with an aspect ratio of about 1:2. In other words, each square pixel 702 is divided vertically and equally into two rectangular subpixels 704, 706.

Figure 8:
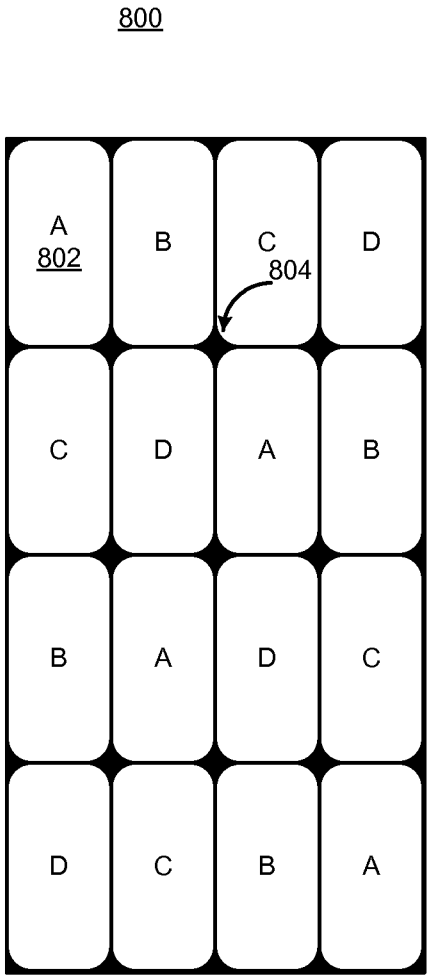
FIG. 8 is a depiction of still another subpixel repeating group in accordance with one embodiment set forth in the disclosure.

In the examples of FIGS. 4-7, each subpixel has a substantially rectangular shape. However, it is understood that the shape of each subpixel in other examples may vary. For example, FIG. 8 depicts one example of a subpixel repeating group 800 having subpixels in a substantially rectangular shape with curved corners. Other shapes of the subpixels include, but are not limited to, substantially round, triangle, pentagon, hexagon, heptagon, octagon, or any other suitable shape. The regions between the subpixels 802 may be filled with the black matrix 804, as noted above.

Figure 9:
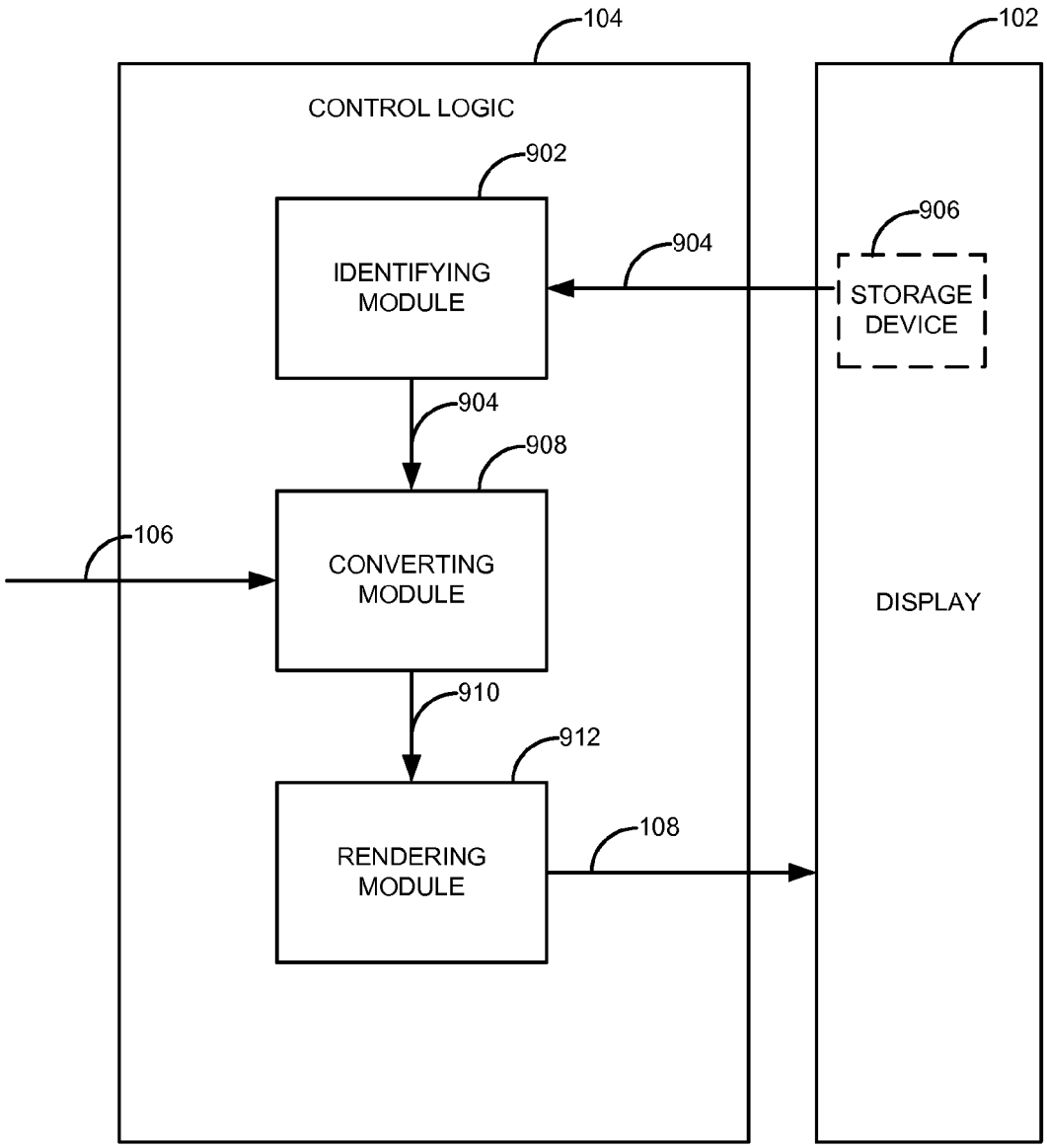
FIG. 9 is a block diagram illustrating one example of the control logic of the apparatus shown in FIG. 1 in accordance with one embodiment set forth in the disclosure.

FIG. 9 depicts one example of the control logic 104 of the apparatus 100 for rendering subpixels of the display 102 with the subpixel arrangements provided above. The "logic" and "module" referred to herein are defined as any suitable software, hardware, firmware, or any suitable combination thereof that can perform the desired function, such as programmed processors, discrete logic, for example, state machine, to name a few. In this example, the control logic 104 includes an identifying module 902 configured to identify the subpixel arrangement 904 of the display 102, such as any one of the subpixel arrangements provided above or any other suitable subpixel arrangement in accordance with the present disclosure. In this example, a storage device 906, for example a ROM as part of the display 102, stores the information regarding the subpixel arrangement 904 of the display 102. The identifying module 902 thus obtains the information regarding the subpixel arrangement 904 from the storage device 906. In another example, the storage device 906 is not part of the display 102, but part of the control logic 104 or any other suitable component of the apparatus 100. In still another example, the storage device 906 is outside the apparatus 100, and the identifying module 902 may load the information of the subpixel arrangement 904 from, for example, a remote database.

The control logic 104 in FIG. 9 also includes a converting module 908 operatively coupled to the identifying module 902. The converting module 908 is configured to convert the received display data 106 from the processor 110, memory 112, and/or the receiver 116 into converted display data 910 based on the identified subpixel arrangement 904 of the display 102. As noted above, the display data 106 may be programmed at the pixel level and thus, includes three parts of data for rendering three subpixels with different colors (e.g., three primary colors of red, green, and blue) for each pixel of the display 102.

For example, the converting module 908 may first calculate converted white subpixel data based on the original primary colors of red, green and blue in the display data 106 for each pixel. In one example, the value of the converted white subpixel data component (W) may be calculated by $$W=\min(R,G,B)/x \quad (1),$$

where x is a predetermined correction value, x≥1, and R, G, and B represent the values of red, green, and blue subpixel components, respectively, in the display data 106 for each pixel.

The converting module 908 then may calculate converted red, green, and blue subpixel data based on the converted white subpixel data and the original red, green, and blue subpixel data. In one example, the values of the converted red, green, and blue subpixel data components (R', G', and B') may be calculated by $$R'=R-W \quad (2)$$

$$G'=G-W \quad (3)$$

$$B'=B-W \quad (4).$$

The converting module 908 may further assign the converted subpixel data to each pixel of the display 102. For example, if the first pixel (e.g., the top left corner) of the display 102 may include a white and a red subpixel, then the converting module 908 may assign the values of W and R' calculated based on the R, G, and B components of the first pixel in the display data 106 to the white and red subpixels on the display 102, respectively. The converting module 908 repeats this process for all the pixels on the display 102 and generates the converted display data 910 for the specifically designed subpixel arrangement 904 of the display 102. It is understood that any other suitable rending algorithm may be applied by the converting module 908 to convert the display data 106 into the converted display data 910.

The control logic 104 in FIG. 9 also includes a rendering module 912 operatively coupled to the converting module 908. The rendering module 912 is configured to provide the control signals 108 for rendering the array of subpixels of the display 102 based on the converted display data 910. As noted above, for example, the control signals 108 may control the state of each individual subpixel of the display 102 by voltage and/or current signals in accordance with the converted display data 910.

Figure 10:
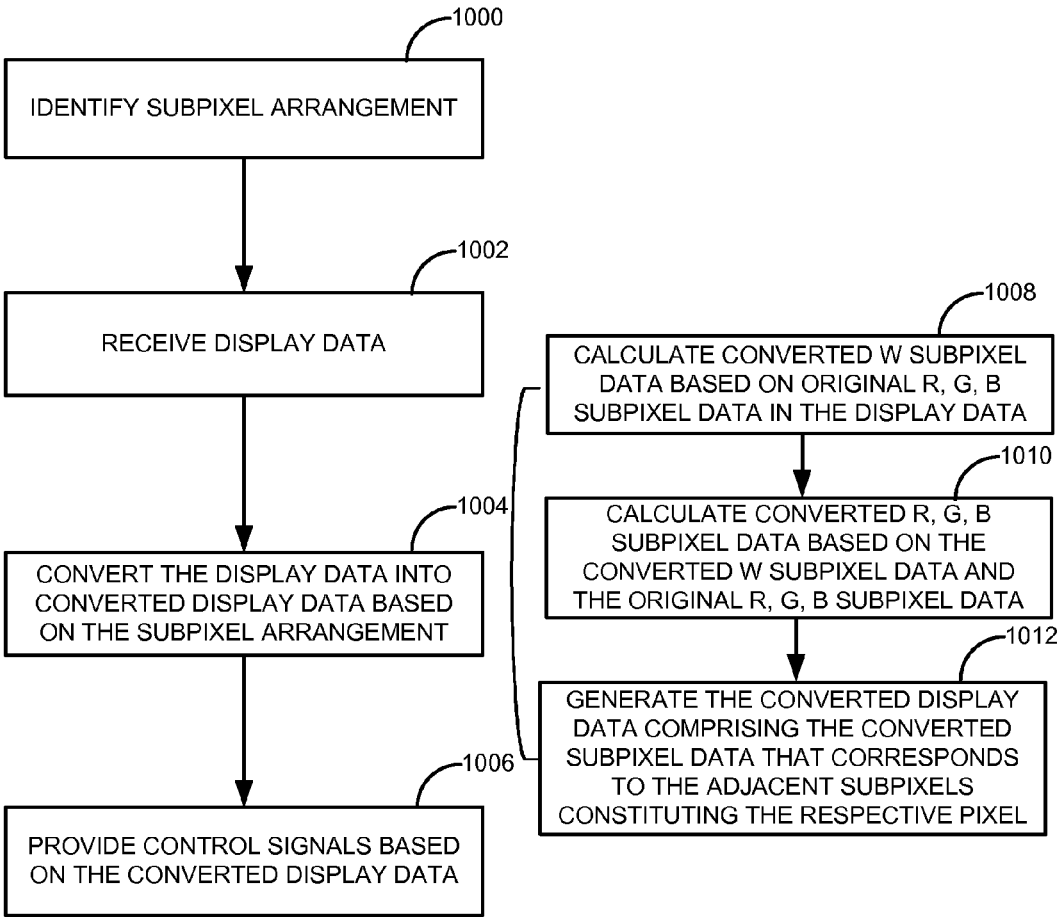
FIG. 10 is a flow chart illustrating a method for rendering subpixels of the display of the apparatus shown in FIG. 1 in accordance with one embodiment set forth in the disclosure.

FIG. 10 depicts one example of a method for rendering subpixels of a display 102. The method may be implemented by the control logic 104 of the apparatus 100 or on any other suitable machine having at least one processor. Beginning at block 1000, an arrangement of an array of subpixels of the display 102 is identified. As described above, block 1000 may be performed by the identifying module 902 of the control logic 104. At block 1002, display data including, for each pixel for display, three parts of original subpixel data for rendering three types of subpixels of the display 102 is received. As described above, block 1002 may be performed by the converting module 908 of the control logic 104. Proceeding to block 1004, the received display data is converted into converted display data based on the identified arrangement of the array of subpixels. As described above, block 1004 may be performed by the converting module 908 of the control logic 104. In one example, block 1004 may include blocks 1008, 1010, and 1012. At block 1008, converted white subpixel data is calculated based on original red, green, and blue subpixel data in the display data. Then at block 1010, converted red, green, and blue subpixel data is calculated based on the converted white subpixel data and the original red, green, and blue subpixel data. At block 1012, the converted display data including the converted subpixel data that corresponds to the adjacent subpixels constituting the respective pixel is generated. Proceeding to block 1006, control signals for rendering the array of subpixels of the display 102 are provided based on the converted display data. As described above, block 1006 may be performed by the rendering module 912 of the control logic 104.

Although the processing blocks of FIG. 10 are illustrated in a particular order, those having ordinary skill in the art will appreciate that the processing can be performed in different orders. For example, block 1002 may be performed prior to block 1000 or performed essentially simultaneously. That is, the display data may be received before or at the same time when the subpixel arrangement of the display 102 is identified.

Aspects of the method for rendering subpixels of a display, as outlined above, may be embodied in programming. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives and the like, which may provide storage at any time for the software programming.

All or portions of the software may at times be communicated through a network such as the Internet or various other telecommunication networks. Such communications, for example, may enable loading of the software from one computer or processor into another. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Nonvolatile storage media include, for example, optical or magnetic disks, such as any of the storage devices in any computer(s) or the like, which may be used to implement the system or any of its components as shown in the drawings. Volatile storage media include dynamic memory, such as a main memory of such a computer platform. Tangible transmission media include coaxial cables; copper wire and fiber optics, including the wires that form a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

The above detailed description of the disclosure and the examples described therein have been presented for the purposes of illustration and description only and not by limitation. It is therefore contemplated that the present disclosure cover any and all modifications, variations or equivalents that fall within the spirit and scope of the basic underlying principles disclosed above and claimed herein.

What is claimed is:

1. An apparatus comprising:

a display panel comprising an array of subpixels having a subpixel repeating group tiled across the display panel in a regular pattern; and control logic operatively coupled to the display panel, configured to receive display data and render the display data into control signals for driving the display panel, wherein the subpixel repeating group comprises four rows of subpixels and four columns of subpixels;

each row of the subpixel repeating group comprises a red subpixel, a green subpixel, a blue subpixel, and a white subpixel;

each column of the subpixel repeating group comprises a red subpixel, a green subpixel, a blue subpixel, and a white subpixel;

subpixels along each diagonal direction of the subpixel repeating group comprise at least two types of the red, green, blue, and white subpixels;

two adjacent subpixels correspond to one pixel;

for each pixel, the display data comprises original red, green, and blue components for rendering the pixel; and the control logic is further configured to, for each pixel, calculate a value of a converted white component based on values of the original red, green, and blue components, calculate values of converted red, green, and blue components based on the values of the original red, green, and blue components, respectively, and the value of the converted white component, and assign values of two of the converted red, green, blue, and white components to the two adjacent subpixels corresponding to the pixel by matching each of the two adjacent subpixels with a converted component in the same color, respectively.

2. The apparatus of claim 1, wherein each subpixel of the array has the same shape and size.

3. The apparatus of claim 1, wherein each subpixel of the array has a substantially rectangular shape with an aspect ratio of about 2:1 or about 1:2.

4. The apparatus of claim 3, wherein each pixel has a substantially square shape and is equally divided into two subpixels each in a substantially rectangular shape.

5. The apparatus of claim 1, wherein the control logic comprises:

an identifying module configured to identify an arrangement of the array of subpixels;

a converting module operatively coupled to the identifying module, configured to convert the display data into converted display data based on the arrangement of the array of subpixels; and a rendering module operatively coupled to the converting module, configured to provide the control signals based on the converted display data.

6. The apparatus of claim 1, further comprising:

a processor configured to generate the display data; and a memory operatively coupled to the processor and the control logic, configured to store the display data.

7. The apparatus of claim 1, further comprising a receiver operatively coupled to the control logic, configured to receive the display data and provide the display data to the control logic.

8. The apparatus of claim 1, wherein the apparatus is one of a liquid crystal display (LCD), an organic light emitting diode (OLED) display, an electrophoretic ink (E-ink) display, and an electroluminescent display (ELD).

9. The apparatus of claim 1, wherein the value of the converted white component is calculated based on a minimum value of the original red, green, and blue components.

10. The apparatus of claim 9, wherein the value of the converted white component is calculated by dividing the minimum value of the original red, green, and blue components by a correction value that is not less than 1.

11. The apparatus of claim 9, wherein the value of the converted red component is calculated by subtracting the value of the converted white component from the value of the original red component;

the value of the converted green component is calculated by subtracting the value of the converted white component from the value of the original green component; and the value of the converted blue component is calculated by subtracting the value of the converted white component from the value of the original blue component.

12. An apparatus comprising:

a display comprising:

a display panel having a filter substrate comprising an array of filters, each filter of the array corresponding to one of an array of subpixels on the display panel, an electrode substrate comprising an array of electrodes, each electrode corresponding to one of the array of subpixels on the display panel and configured to drive the corresponding subpixel, and a liquid crystal layer disposed between the filter substrate and the electrode substrate; and a backlight panel configured to provide lights to the display panel; and control logic operatively coupled to the display, configured to receive display data and render the display data into control signals for driving the display panel, wherein the array of subpixels comprises a subpixel repeating group tiled across the display panel in a regular pattern;

the subpixel repeating group comprises four rows of subpixels and four columns of subpixels;

each row of the subpixel repeating group comprises a red subpixel, a green subpixel, a blue subpixel, and a white subpixel;

each column of the subpixel repeating group comprises a red subpixel, a green subpixel, a blue subpixel, and a white subpixel;

subpixels along each diagonal direction of the subpixel repeating group comprise at least two types of the red, green, blue, and white subpixels;

two adjacent subpixels correspond to one pixel;

for each pixel, the display data comprises original red, green, and blue components for rendering the pixel; and the control logic is further configured to, for each pixel, calculate a value of a converted white component based on values of the original red, green, and blue components, calculate values of converted red, green, and blue components based on the values of the original red, green, and blue components, respectively, and the value of the converted white component, and assign values of two of the converted red, green, blue, and white components to the two adjacent subpixels corresponding to the pixel by matching each of the two adjacent subpixels with a converted component in the same color, respectively.

13. The apparatus of claim 12, wherein each subpixel of the array has the same shape and size.

14. The apparatus of claim 12, wherein the control logic comprises:

an identifying module configured to identify an arrangement of the array of subpixels;

a converting module operatively coupled to the identifying module, configured to convert the display data into converted display data based on the arrangement of the array of subpixels; and a rendering module operatively coupled to the converting module, configured to provide the control signals based on the converted display data.

15. The apparatus of claim 12, further comprising:

a processor configured to generate the display data; and a memory operatively coupled to the processor and the control logic, configured to store the display data.

16. The apparatus of claim 12, further comprising a receiver operatively coupled to the control logic, configured to receive the display data and provide the display data to the control logic.

17. A method, implemented on a machine having at least one processor, for rendering subpixels of a display panel, comprising:

identifying an arrangement of an array of subpixels of the display panel, two adjacent subpixels corresponding to one pixel;

receiving display data comprising, for each pixel, original red, green, and blue components for rendering the pixel;

for each pixel, converting the display data into converted display data based on the arrangement of the array of subpixels by:

calculating a value of a converted white component based on values of the original red, green, and blue components, calculating values of converted red, green, and blue components based on the values of the original red, green, and blue components, respectively, and the value of the converted white component, and assigning values of two of the converted red, green, blue, and white components to the two adjacent subpixels corresponding to the pixel by matching each of the two adjacent subpixels with a converted component in the same color, respectively; and providing control signals for rendering the array of subpixels of the display panel based on the converted display data, wherein the array of subpixels comprises a subpixel repeating group tiled across the display panel in a regular pattern;

the subpixel repeating group comprises four rows of subpixels and four columns of subpixels;

each row of the subpixel repeating group comprises a red subpixel, a green subpixel, a blue subpixel, and a white subpixel;

each column of the subpixel repeating group comprises a red subpixel, a green subpixel, a blue subpixel, and a white subpixel; and subpixels along each diagonal direction of the subpixel repeating group comprise at least two types of the red, green, blue, and white subpixels.

* * * * *